US006581560B1

(12) United States Patent
Mammarella

(10) Patent No.: US 6,581,560 B1
(45) Date of Patent: Jun. 24, 2003

(54) MOLDED INTAKE MANIFOLD WITH SEPARATE INLET ENTRY RUNNERS

(75) Inventor: John R. Mammarella, Windsor (CA)

(73) Assignee: Siemens VDO Automotive Inc., Chahtam (CA)

( * ) Notice: Subject to any disclaimer, the term of this patent is extended or adjusted under 35 U.S.C. 154(b) by 0 days.

(21) Appl. No.: 09/689,190

(22) Filed: Oct. 12, 2000

Related U.S. Application Data

(60) Provisional application No. 60/159,415, filed on Oct. 14, 1999.

(51) Int. Cl.[7] ..... F02M 35/10
(52) U.S. Cl. ..... 123/184.31; 123/184.61
(58) Field of Search ..... 123/184.31, 184.61

(56) References Cited

U.S. PATENT DOCUMENTS 4,301,775 A * 11/1981 Smart et al. ..... 123/184.61
5,357,931 A * 10/1994 Semence ..... 123/184.61
5,875,758 A * 3/1999 Fujita ..... 123/184.61
5,947,073 A * 9/1999 Chaffin et al. ..... 123/184.61
6,267,092 B1 * 7/2001 Matsumoto et al. ... 123/184.57
6,267,093 B1 * 7/2001 Lohr ..... 123/184.61

* cited by examiner

*Primary Examiner*—Marguerite McMahon
*Assistant Examiner*—Jason Benton

(57) ABSTRACT

An intake manifold is molded of two plastic parts. A first main manifold body provides the outer cover and an inner opening. A second runner provides a plurality of entry ports for communicating air to cylinders within the engine. In the past, it has been somewhat difficult to control the shape of the entry ports when the manifold was molded of a single part. The use of the separate runner allows the provision of a relatively thin and easily molded part such that the entry ports can be closely controlled and an idealized design can be achieved.

13 Claims, 3 Drawing Sheets

MOLDED INTAKE MANIFOLD WITH SEPARATE INLET ENTRY RUNNERS

This application claims priority to Provisional Patent Application Serial No. 60/159,415 filed Oct. 14, 1999.

BACKGROUND OF THE INVENTION

This application relates to a molded plastic intake manifold wherein entry ports are formed within a separate runner such that the ports can be formed as close as possible to an idealized configuration.

Intake manifolds receive and distribute air to a number of cylinders within a vehicle engine. Historically, the intake manifold has been formed of metal. More recently, manifolds have been molded from plastics. One portion of the intake manifolds that is the subject of much design effort is the configuration of the entry ports leading from the manifold into engine cylinders. The entry ports typically have a closely designed curved surface intended to smoothly guide airflow into the engine cylinders.

The prior art formed the entry ports and the overall manifold body as a single molded part. It is difficult to achieve entry ports having the exact desired shape from a single molded part.

SUMMARY OF THE INVENTION

In a preferred embodiment of this invention, a molded plastic intake manifold is formed having a main inlet manifold body formed as a first part, and entry ports molded as a separate part. Preferably, the entry ports are formed in a runner which creates a number of the entry ports with a single part. The runner and the main body part are connected together to form the manifold. Since the runner is a relatively small and relatively flat item, the configuration of the entry ports can be closely controlled. Entry ports having the exact desired configuration can be achieved.

In one embodiment, the entry ports are formed in a runner including half portions of the ports. The other half of the port is formed within the main manifold body. One disclosed embodiment includes two separate runners, with the two separate runners positioned on opposed sides of the main manifold body.

In a more preferred embodiment, the runner has connecting webs connecting the runners on each side of the manifold. Further, the runners preferably define the entire entry port.

The runners may be pinned to the main manifold body, and then welded. In the preferred embodiment, the runner rests on a ledge on the manifold body before being welded. Although plastic welding is the preferred method of attaching the two, other attachment methods may be utilized.

These and other features of the present invention will be best understood from the following specification and drawings, the following of which is a brief description.

DETAILED DESCRIPTION OF A PREFERRED EMBODIMENT

Figure 1A:
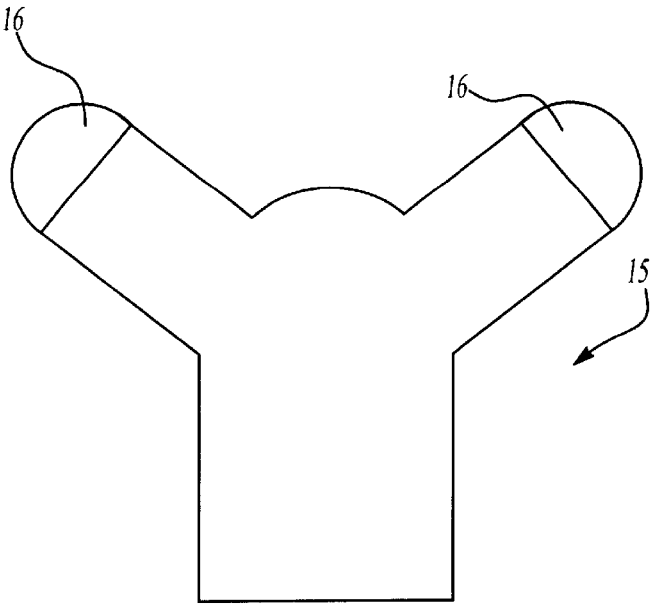
FIG. 1A shows an intake manifold sitting atop a vehicle cylinder.

As shown in FIG. 1A, a vehicle engine 15 incorporates an engine block which receives an intake manifold 16. The intake manifold is preferably molded of plastic, and the structure of the intake manifold is shown in FIG. 1B.

Figure 1B:
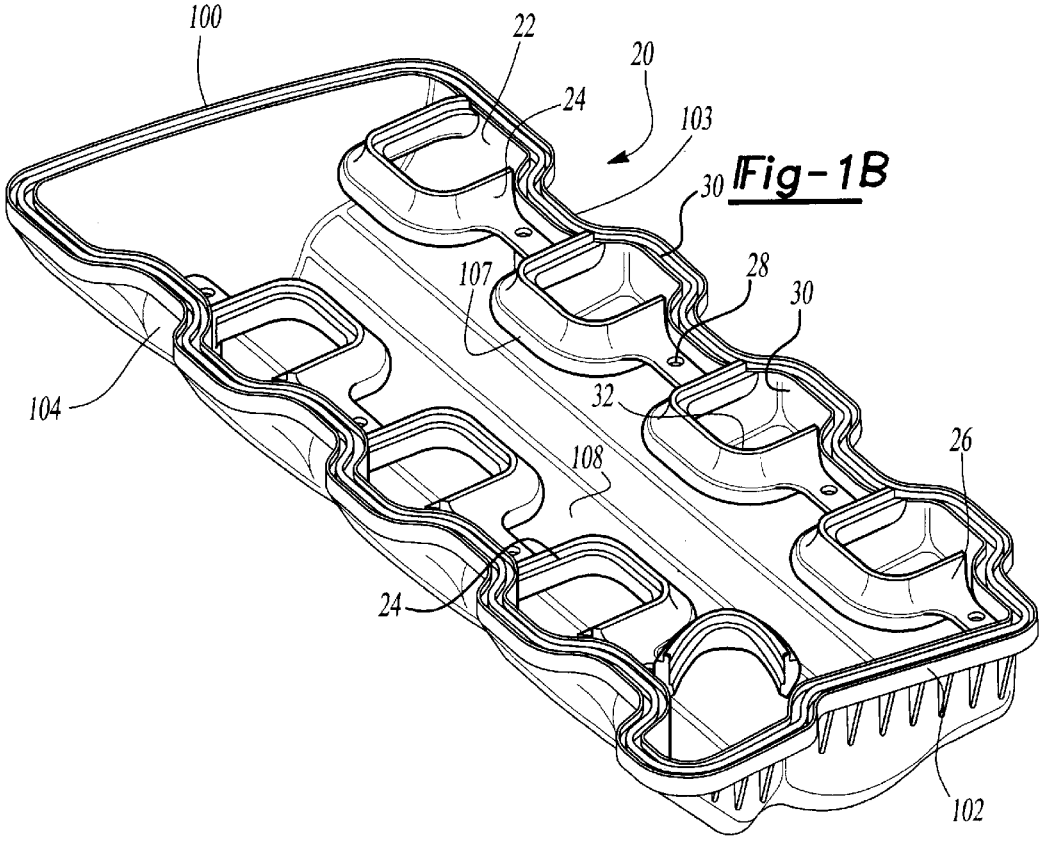
FIG. 1B shows the inner surface of a molded plastic intake manifold.

As shown in FIG. 1B, the intake manifold 20 incorporates an outer manifold body 22 and a runner 24. The runner 24 includes a plurality of entry ports 26 which are positioned above cylinder in the engine 15, as known. Connecting webs 28 connect the plurality of ports 26. In this embodiment, an inner wall 30 of the main body 22 provides a portion of the entry port along with a curved surface 32 on the runners 24.

Figure 2:
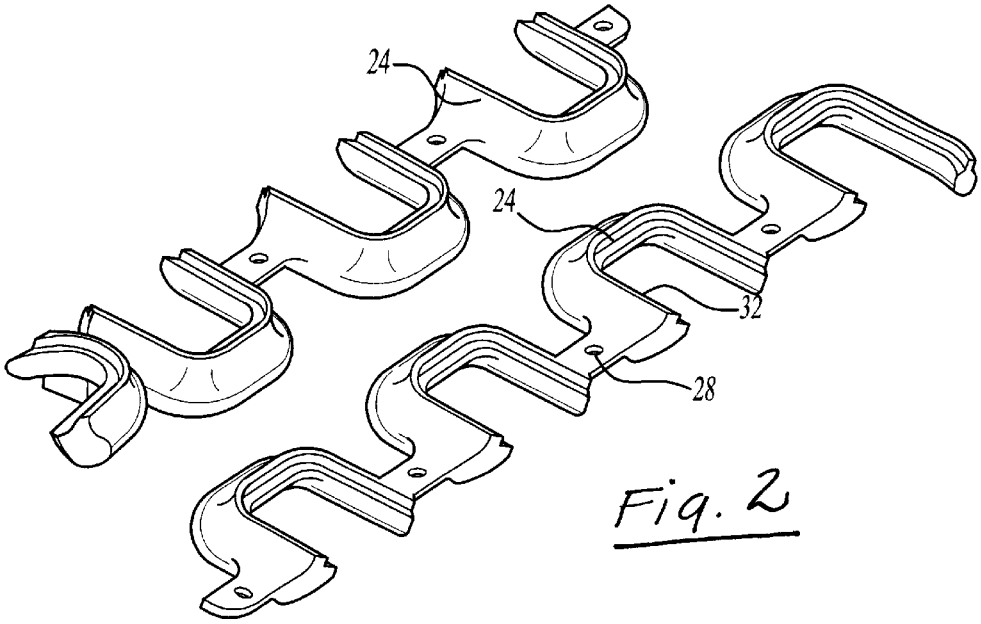
FIG. 2 shows a runner body as is part of the FIG. 1B embodiment.

As can be appreciated from FIG. 2, the runners 24 are relatively flat parts. Due to the relatively flat shape, the runners 24 can be easily molded such that the shape of the entry port 32 can be closely controlled. As mentioned above, in the field of engine design, it is known that a specific shape would be desired for the ports 32. In the past, it has been somewhat difficult to achieve the specific shape with the one-piece molded plastic intake manifolds. The inventive use of a separate intake manifold runner allows the control of the molding process to provide the specific shape. As can be appreciated from a comparison of FIGS. 1B and 2, the ports 26 have three walls defined by the runners and one wall defined by the body 22.

The runners shown in FIG. 2 have structure such as shown at 28 to receive a pin from the main body, such that the runner can be supported on the main body 22 until being welded. Vibration or ultrasonic welding techniquesmay be utilized.

Figure 3:
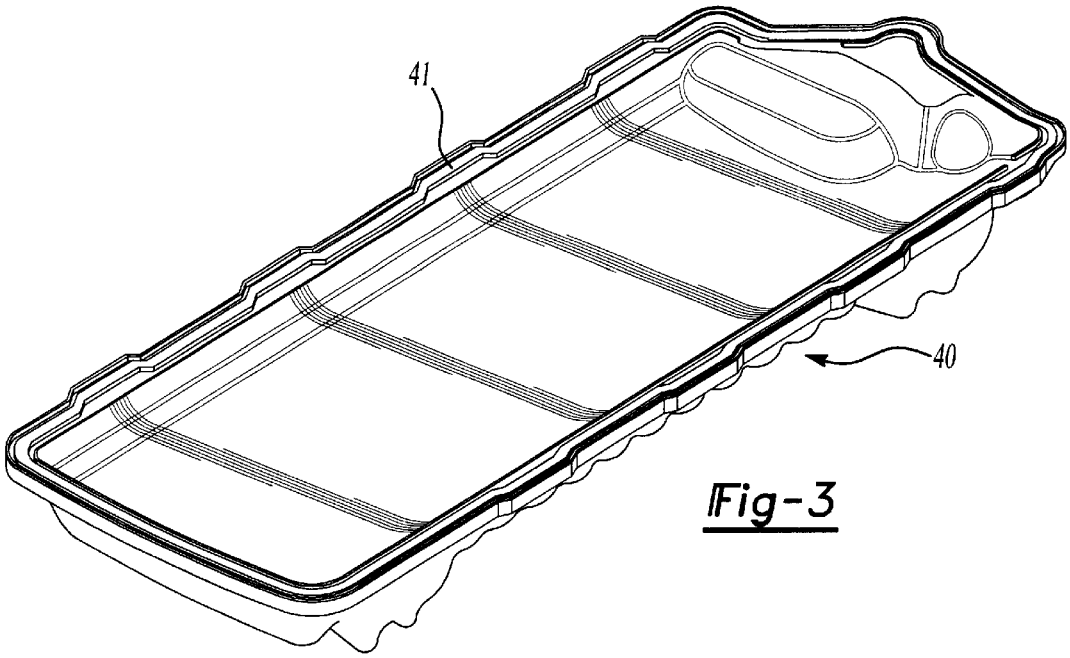
FIG. 3 shows the interior of the manifold body of a second embodiment.
Figure 4:
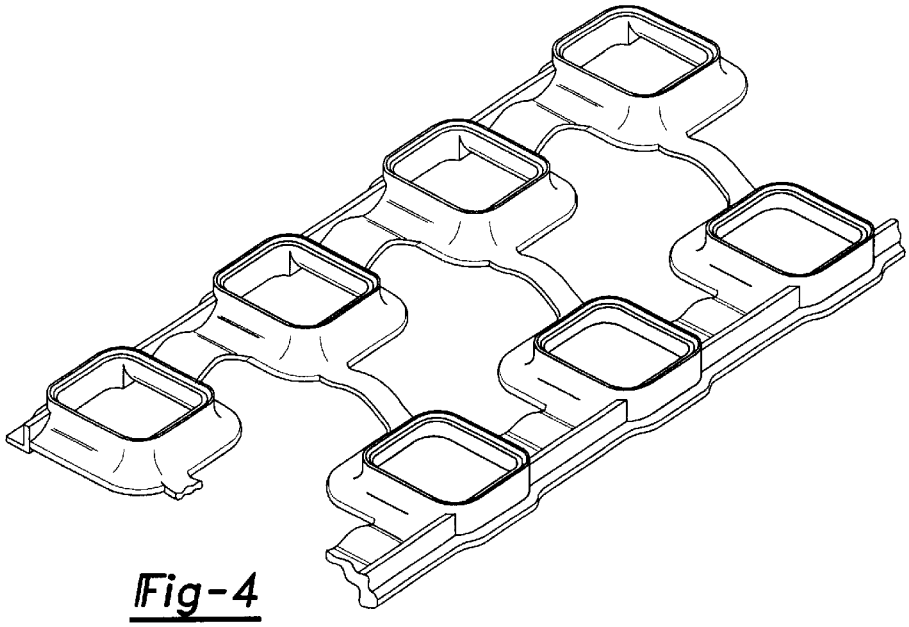
FIG. 4 shows a side of a preferred runner which will face the engine.
Figure 5:
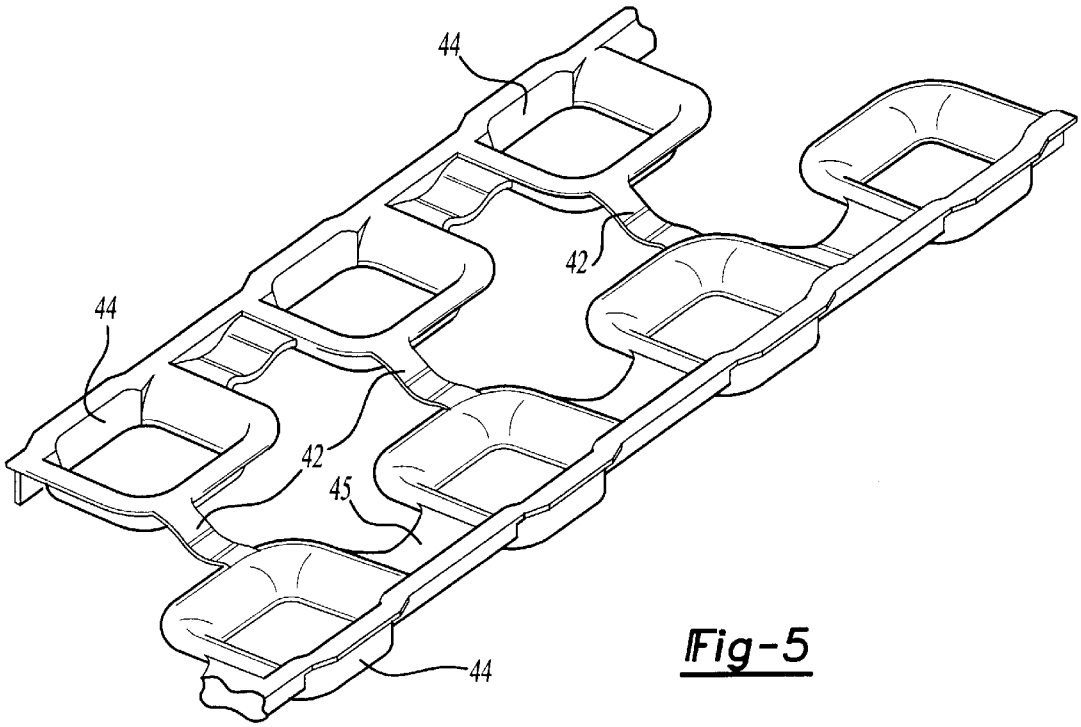
FIG. 5 shows the opposed side of the runner of FIG. 4.

FIG. 3 shows the interior of a main body 40 for a preferred embodiment. As shown, a ledge 41 will support a runner 43 shown in FIG. 4. FIG. 4 shows the surface which faces the engine, and having entry ports 44. As shown, webs 42 connect the opposed ports 44, such that a single run piece 43 provides the runners for both side of the manifold. A in the prior embodiment, adjacent ports are alo connected by a web 45. As shown in FIG. 4, the surface of the part 43 which will face into the manifold body 40 look somewhat similar to the earlier embodiments. As can be appreciated from the Figures, the web 42 extend only between the intake port portions, and do not extend over the entire length of the runner body.

As with the prior embodiment, the structure 44 of the entry port can be closely designed and the relatively thin molded part allows the specific shape desired to be achieved.

With this embodiment, the runner 43 can be merely placed on the ledge 41 of the main body 40, and welding then performed. In this way, a combined intake manifold and runner body is provided. The use of the relatively thin runners allow close control to achieve a desired and ideal shape for the various curved surfaces leading into the entry ports. As such, the present invention allows use of the plastic molding to provide a part which has not been capable of idealized plastic molding in the past.

As can be appreciated from FIG. 1B, the main manifold body extends between two ends 100, 102, and between two lateral sides 104, 103. The runners 24 are positioned along each of the two lateral sides 104, 106 to define the entry ports. The runners have an inner face 107 facing a rear wall 108 of the main body that is spaced from that rear wall. Further, the entry ports are generally defined in a plane at an end surface of the main body defining an open portion of the main body. While the reference numbers mentioned above are shown with regard to the FIG. 1B embodiment, it should be understood that the other runner embodiments would have the same features mentioned above.

Preferred embodiments of this invention have been disclosed, however, a worker in this art would recognize that certain modifications would come within the scope of this invention. For that reason the following claims should be studied to determine the true scope and content of this invention.

What is claimed is:

1. A plastic intake manifold comprising:

a main manifold body including an outer cover surface and an opening at an end spaced from said outer cover surface, said opening for being mounted on an engine, said opening extending between two longitudinal ends, and two lateral sides; and a generally flat separate runner, said runner defining a plurality of entry ports for communicating air to cylinders on an engine block, said runner and said main body being each molded as separate pieces from plastic and secured together, there being two of said runners, with one extending along each of said lateral sides to define a plurality of entry ports at each of said lateral sides, such that said runners generally lie in a plane defined by an outer surface of said opening in said main manifold body, said runners are provided on each lateral side of said main manifold body, and said runners being connected by webs between said two runners, such that a single runner body provides entry ports on each of two lateral sides of said manifold body, said webs only extending between said entry ports, and not for an entire length of said runner body.

2. A manifold as set forth in claim 1, wherein laterally inner portions of said runner being positioned above said outer cover surface of said main manifold body, but spaced from an inner face of said outer cover.

3. A manifold as set forth in claim 1, wherein said runner is positioned on a ledge defined by said main manifold body.

4. A plastic manifold as set forth in claim 1, wherein said entry ports have curved surfaces extending away from said outer cover wall of said body to guide air into cylinders on a vehicle engine.

5. A method as set forth in claim 4, wherein said runners are provided at each of two opposed lateral sides of manifold body, and there being separate runners each separately molded and connected to said manifold body.

6. A method as set forth in claim 4, wherein there are entry ports provided on each of two lateral sides of said manifold body, and a single runner provides entry ports at said opposed lateral sides of said manifold body.

7. A method as set forth in claim 4, wherein said molded manifold and runner is then attached to a vehicle engine.

8. A manifold as set forth in claim 1, wherein each of said runners include a plurality of entry ports, with webs connecting each of said plurality of ports in each of said runners.

9. A manifold comprising:

a main manifold body including an outer cover surface and an opening at an end spaced from said outer cover surface, said opening for being mounted on an engine, said opening extending between two longitudinal ends, and two lateral sides;

a generally flat separate runner, said runner defining a plurality of entry ports for communicating air to cylinders on an engine block, said runner and said main body being each molded as separate pieces from plastic and secured together, said runner extending along said lateral sides to define a plurality of entry ports at each of said lateral sides, such that said runner generally lies in a plane defined by an outer surface of said opening in said main manifold body; and said entry ports are only partially defined by said runner, with the lateral edges of said main body defining a portion of said entry port.

10. A method for providing a molded intake manifold providing the steps of:

1) molding a main manifold body having an outer cover with an inner face and an inner opening spaced from said outer cover, said inner opening extending between two longitudinal ends and two lateral sides;

2) molding a runner body, said runner body being relatively thin and defining a plurality of entry ports; and 3) connecting said runner body to said main manifold body such that there are entry ports along each of said lateral sides of said main manifold body, and such that said runner generally lies in a plane defined by the inner opening on said main manifold body with said entry ports extending generally outwardly of said plane for communication of air to an engine, with said runners provided on each lateral side of said main manifold body, said runners being connected by webs between said two runners such that a single runner body provides entry ports on each two lateral sides of said manifold body, and said webs only extending between at least some of said entry ports such that said webs do not extend for an entire length of said body.

11. A method for providing a molded intake manifold providing the steps of:

1) molding a main manifold body having an outer cover with an inner face and an inner opening spaced from said outer cover, said inner opening extending between two longitudinal ends and two lateral sides;

2) molding a runner body, said runner body being relatively thin and defining a plurality of entry ports; and 3) connecting said runner body to said main manifold body such that there are entry ports along each of said lateral sides of said main manifold body, and such that said runner generally lies in a plane defined by the inner opening on said main manifold body with said entry ports extending generally outwardly of said plane for communication of air to an engine, said runner body only providing a plurality of sides of said entry ports, with lateral sides of said main manifold body providing at least one side of said entry port.

12. A plastic manifold as set forth in claim 9, wherein said runner generally provides three sides of said intake port and said manifold body generally provides one side.

13. A method as set forth in claim 11, wherein said runner body generally provides three sides of said entry ports with said manifold body providing a fourth side.

* * * * *